US010717568B2

(12) United States Patent
Defert

(10) Patent No.: US 10,717,568 B2
(45) Date of Patent: Jul. 21, 2020

(54) PERFORATING CAP FOR A FLEXIBLE TUBE

(71) Applicant: ALBEA SERVICES, Gennevilliers (FR)

(72) Inventor: Sylvain Defert, Saint Ouen l'Aumone (FR)

(73) Assignee: ALBEA SERVICES, Gennevilliers (FR)

( * ) Notice: Subject to any disclaimer, the term of this patent is extended or adjusted under 35 U.S.C. 154(b) by 281 days.

(21) Appl. No.: 15/491,452

(22) Filed: Apr. 19, 2017

(65) Prior Publication Data

US 2017/0297788 A1 Oct. 19, 2017

(30) Foreign Application Priority Data

Apr. 19, 2016 (FR) ..... 16 53453
Jun. 23, 2016 (FR) ..... 16 55899
Mar. 7, 2017 (FR) ..... 17 51859

(51) Int. Cl.
*B65D 51/22* (2006.01)
*B65D 35/44* (2006.01)
(Continued)

(52) U.S. Cl.
CPC ..... *B65D 51/225* (2013.01); *B65D 1/0246* (2013.01); *B65D 35/44* (2013.01);
(Continued)

(58) Field of Classification Search
CPC .... B65D 51/225; B65D 51/222; B65D 35/44; B65D 47/36; B65D 41/06; B65D 41/04;
(Continued)

(56) References Cited

U.S. PATENT DOCUMENTS 2,771,218 A 11/1956 Henderson
3,339,812 A * 9/1967 Meissner ..... B65D 51/222 220/278
(Continued)

FOREIGN PATENT DOCUMENTS

FR 2234206 1/1975
LU 88845 A1 6/1998
(Continued)

OTHER PUBLICATIONS

Machine translation of JP 2008056334. Espacenet 2019. http://translationportal.epo.org/emtp/translate/?ACTION=description-retrieval&COUNTRY=JP&ENGINE=google&FORMAT=docdb&KIND=A&LOCALE=en_EP&NUMBER=2008056334&OPS=ops.epo.org/3.2&SRCLANG=ja&TRGLANG=en (Year: 2019).*

*Primary Examiner* — James N Smalley
(74) *Attorney, Agent, or Firm* — Steven M. Greenberg, Esq.; Shutts & Bowen LLP

(57) ABSTRACT

The present invention relates to a tube closure assembly. The assembly includes a tube head that includes a neck and a closure liner sealing said neck, and a cap that includes a punch provided with at least one tooth. The one or more teeth are configured to peripherally cut said closure liner. The cap is configured to transition from an open flush position, in which the one or more teeth are flush with said closure liner, to a perforation position, in which the one or more teeth perforate the closure liner, then from the perforation position to an end-of-travel position allowing partial cutting of the closure liner, the transition from the perforation position to the end-of-travel position being carried out with an angular rotational range below 360°.

14 Claims, 5 Drawing Sheets

(51) Int. Cl.

| | |
|---|---|
| ***B65D 1/02*** | (2006.01) |
| ***B65D 41/02*** | (2006.01) |
| ***B65D 41/04*** | (2006.01) |
| ***B65D 41/06*** | (2006.01) |
| ***B65D 47/36*** | (2006.01) |

(52) U.S. Cl.
CPC ..... *B65D 41/02* (2013.01); *B65D 41/04* (2013.01); *B65D 41/06* (2013.01); *B65D 47/36* (2013.01); *B65D 51/222* (2013.01); *B65D 2251/009* (2013.01); *B65D 2251/0015* (2013.01); *B65D 2251/0028* (2013.01); *B65D 2251/0093* (2013.01)

(58) Field of Classification Search
CPC ..... B65D 1/0246; B65D 41/02; B65D 2251/009; B65D 2251/0028; B65D 2251/0015; B65D 2251/0093
USPC ..... 220/278; 222/83
See application file for complete search history.

(56) References Cited

U.S. PATENT DOCUMENTS

| | | | | |
|---|---|---|---|---|
| 4,867,326 | A | 9/1989 | O'Meara | |
| 4,982,875 | A * | 1/1991 | Pozzi | B65D 51/285 222/129 |
| 5,566,845 | A * | 10/1996 | Frank | B65D 25/44 215/208 |
| 5,947,318 | A * | 9/1999 | Palm | B65D 5/746 220/278 |
| 8,944,271 | B2 | 2/2015 | Seguin | |
| 2007/0289937 | A1 * | 12/2007 | Kaneko | B65D 5/748 215/252 |
| 2008/0245380 | A1 | 10/2008 | Ecker | |
| 2016/0194122 | A1 | 7/2016 | Kerman et al. | |

FOREIGN PATENT DOCUMENTS

| | | |
|---|---|---|
| WO | WO9700816 | 1/1997 |
| WO | WO2008029585 | 3/2008 |

* cited by examiner

PERFORATING CAP FOR A FLEXIBLE TUBE

CROSS REFERENCE TO RELATED APPLICATIONS

This application claims priority under 35 U.S.C. § 119(a) to French Patent Application Serial Number 1653453, filed Apr. 19, 2016, French Patent Application Serial Number 1655899, filed Jun. 23, 2016, and French Patent Application Serial Number 1751859, filed Mar. 7, 2017, the entire teachings of which are incorporated herein by reference.

BACKGROUND OF THE INVENTION

Field of the Invention

The present invention relates to the field of flexible tubes including a closure liner sealing the neck prior to the first use of the tube, and to a perforating cap adapted to perforate the closure liner.

Description of the Related Art

Tubes are known that are provided with a closure liner associated with a perforating cap including a punch adapted to perforate the closure liner.

The closure liner allows the product contained inside the tube to be hermetically preserved while it is stored, prior to its first use, which represents a significant part of the overall lifetime of the tube.

Caps exist in which the punch is disposed inside the cap and projects therefrom in order to be able to perforate the closure liner when the cap is screwed onto the tube head. It is particularly advantageous for a cap to be provided for which the punch allows partial cutting of the closure liner. Indeed, with a full cut, the closure liner risks being mixed with the contents of the tube.

Conventionally, several turns are required in order for a cap to transition from an open position to a closed position. In particular, tubes have already been proposed that require three turns in order to transition from a position where the punch is flush with the closure liner to an end-of-travel position. During these three turns, the closure liner is perforated, then progressively sheared in order to achieve the desired partial cut.

A requirement exists for a tube closure assembly that allows the handling of the assembly to be facilitated, particularly during the partial cutting of the closure liner.

BRIEF SUMMARY OF THE INVENTION

To this end, the present disclosure proposes a tube closure assembly. The assembly includes a tube head including a neck and a closure liner sealing the neck, a cap including a punch provided with at least one tooth, with the one or more teeth being configured to make a cut, particularly a peripheral cut, in the closure liner. According to the invention, the cap is configured to transition from a position—a flush position—in which the one or more teeth are flush with the closure liner, to a position—a perforation position—in which the one or more teeth have perforated the closure liner, then from the perforation position to an end-of-travel position allowing partial cutting of the closure liner, the transition from the perforation position to the end-of-cutting position being carried out with an angular rotational range below 360°.

Thus, the invention is based on the applicant observing that a cut can be made in a closure liner with a reduced number of cap turns by distinguishing between the angular range required to perforate the closure liner, which will substantially depend on the elasticity thereof, and the angular range needed for the cut. By then providing an angular cutting range below 360°, a fast and clean partial cut of the closure liner is obtained during the first use of the tube. This facilitates the handling of the assembly by the user, particularly by saving time for cutting the closure liner.

A cap is understood to be an object that allows leak-tight sealing of a receptacle, particularly an opening for discharging a product, in a reversible manner. A cap according to the invention thus can transition from an open position to a closed position and vice versa, mainly through a screwing or equivalent movement. The present invention can exclude closure assemblies, such as a hinged service capsule, that are definitively or non-definitively fixed onto an opening and comprise a through hole for discharging the product and a tilting cover for sealing the hole.

According to various embodiments of the invention, which can be taken separately or in combination:

- the tube head further includes a shoulder;
- the neck and the shoulder are designed as a single-piece;
- the neck and the shoulder are integrally formed;
- the end-of-travel position corresponds to a closed position of the cap;
- the punch has an outer diameter substantially corresponding to an inner diameter of the neck, to within a clearance;
- the punch has a distal end provided with the one or more teeth;
- at least two of the teeth are provided;
- an angular range for transitioning between the flush position and the end-of-travel position is between 120° and 320°;
- the teeth are angularly spaced apart from each other so that their angular travel overlaps, particularly between the flush position and the end-of-travel position, even more specifically between the perforation position and the end-of-travel position;
- the height of the one or more teeth is higher than, or equal to, the axial travel of the cap between the perforation position and the end-of-travel position;
- the teeth have a triangular profile;
- the height of the teeth is identical and, preferably, the cap is then configured so that an overlap of the angular travel between two angularly adjacent teeth is between 20° and 40°;
- the height of at least one first tooth of the teeth is higher than, or equal to, the elongation value of the closure liner, the tooth being configured to perforate the closure liner;
- the height of a second tooth of the teeth is lower than the elongation value of the closure liner, the second tooth being configured to shear the closure liner;
- the height of the teeth decreases in the inverse of the direction of rotation of the cap, and, preferably, the cap is then configured so that an overlap of the angular travel between two angularly adjacent teeth is between 20° and 350°;
- the end includes three cutting teeth;
- the end includes four cutting teeth;
- the teeth are evenly distributed along the angular range;
- the teeth are distributed on less than 270°, or less than 180°, or less than 120° of the periphery of the end of the punch;

three teeth are provided and are distributed, in particular evenly, on 180° of the periphery of the end of the punch;

four teeth are provided and are distributed, in particular evenly, on 220°;

the cap is configured so that the partial cutting allows the closure liner to remain connected to the tube head via an extension of material on an angular range between 20° and 50°;

the assembly is configured to allow the cap to be fixedly held on the neck in a standby position, in which the punch is held at a distance from the closure liner;

the neck and the cap are configured to hold the cap in place at a distance from the closure liner, in the standby position, prior to a first use;

the neck includes at least one guide groove configured to cooperate with the cap, to allow the cap to transition from the standby position to the end-of-travel position;

the assembly further includes a detachable ring placed around the neck between the shoulder of the tube head and the cap, to hold the cap in place, in the standby position, at a distance from the closure liner, prior to a first use;

the neck includes an upper end located in the vicinity of a discharge hole and a lower end opposite the upper end;

the closure liner is located at the lower end of the neck;

the tube head includes an insert;

the closure liner defines a central zone of the insert;

the insert at least partly covers a lower face of the shoulder.

According to an advantageous embodiment, the cap is configured so that the transition from the standby position to the end-of-travel position is carried out with an angular rotational range between one and two turns, preferably one and a half turns, and so that the transition from the perforation position to the end-of-travel position is carried out with an angular rotational range between 90° and 200°.

The invention further relates to a tube including an assembly as previously described.

The invention further relates to a cap for an assembly or to a tube as previously described.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 6:
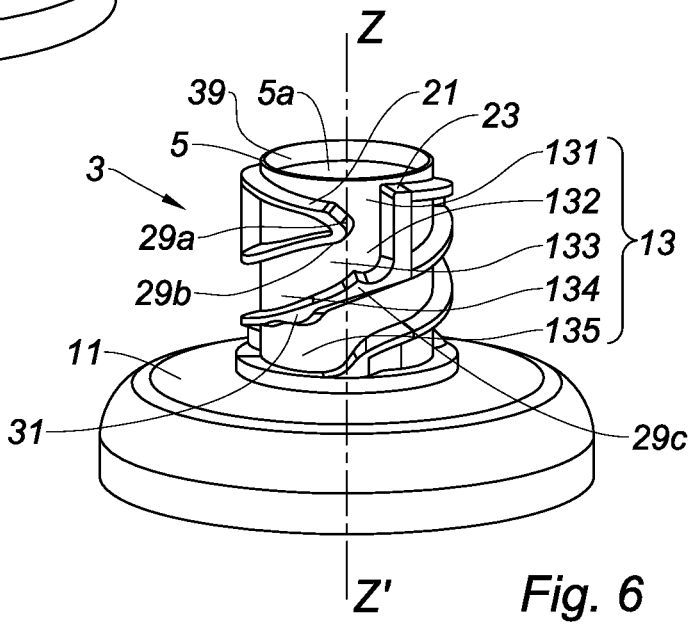
FIG. 6 is a perspective view of a tube, partially shown, including a second variant of a tube head for an assembly according to the invention intended to cooperate with one of the caps of FIGS. 1 to 4.
Figure 7:
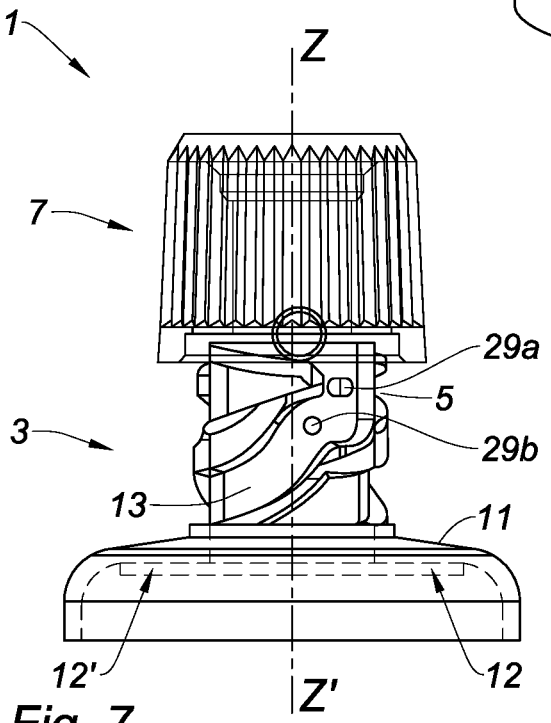
FIG. 7 is an elevation view of the tube of FIG. 5, on which a cap of FIGS. 1 to 4 is directed towards a standby position, the tube head and the cap forming a tube closure assembly according to the invention.
Figure 11:
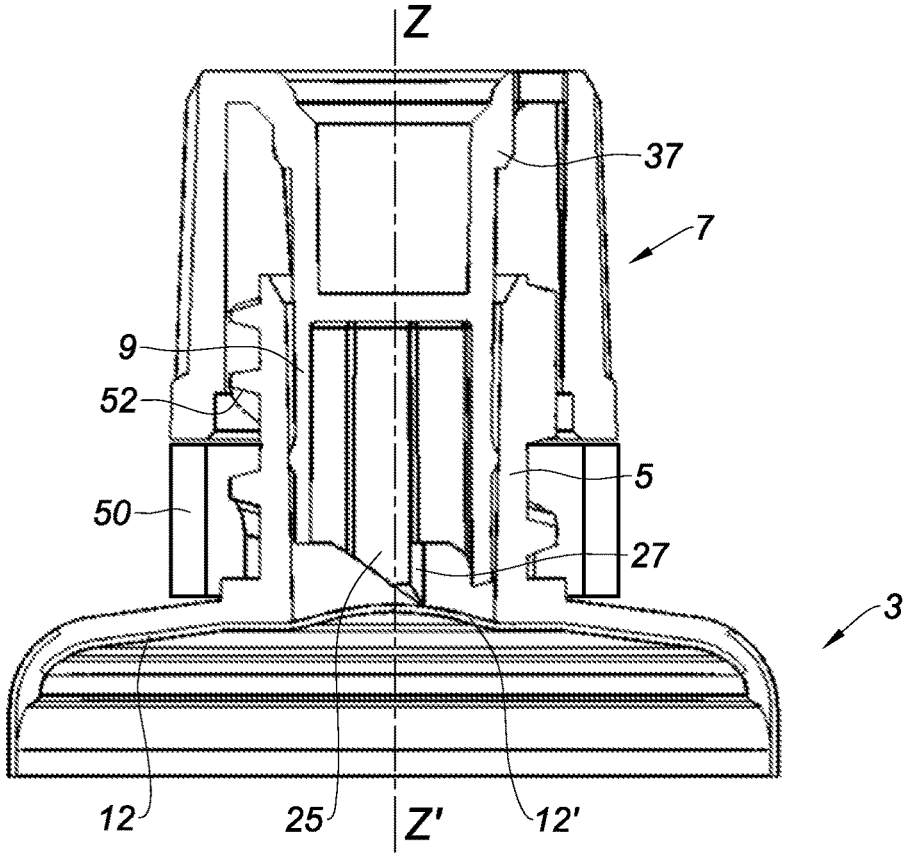
FIG. 11 is an axial section view showing a variant of an embodiment of the assembly according to the invention in the standby position.
Figure 12:
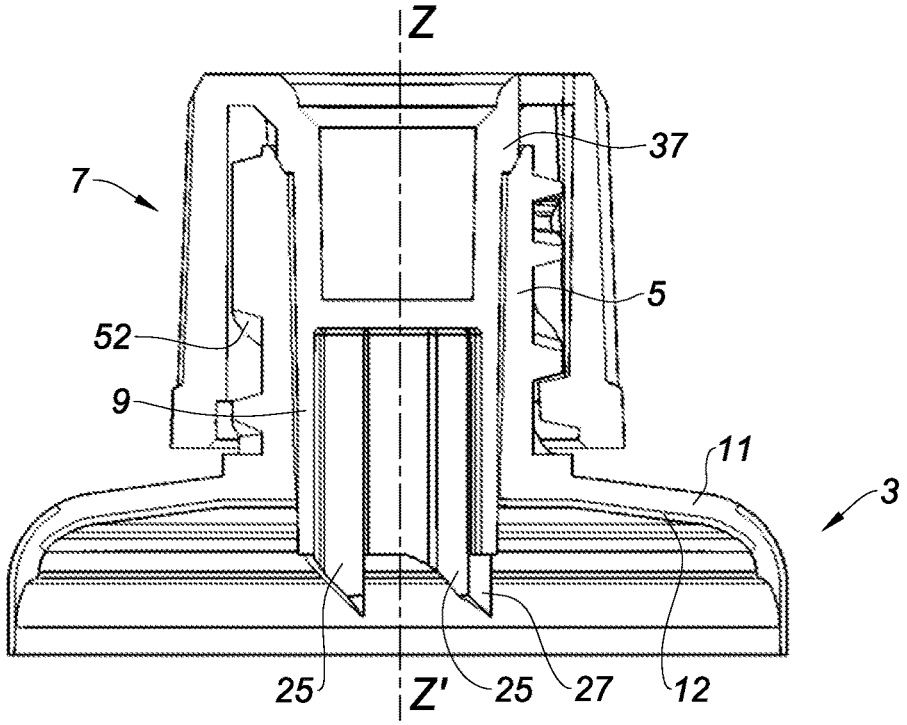
FIG. 12 is as FIG. 11, the assembly being in the end-of-travel and/or closed position.

A tube closure assembly is described. The assembly 1 includes a tube head 3 including a neck 5 and a closure liner sealing the neck 5 and a cap 7 including a punch 9 configured to cut the closure liner. The tube head 3, a first variant of which is shown in FIGS. 5 and 7 to 10, a second variant of which is shown in FIG. 6 and a third variant of which is shown in FIGS. 11 and 12, includes the neck 5 defining a longitudinal axis Z-Z', a shoulder 11 and a full insert 12 forming the closure liner 12' at its centre. The closure liner seals the neck 5 in the lower part thereof. As shown herein, the neck 5 and the shoulder 11 are designed as a single-piece and are integrally formed.

The neck 5 in this case is in the form of a cylinder extending from an upper end, which is located towards the outside of the tube, towards a lower end, which is opposite the upper end and is directed towards the inside of the tube. The upper end has a discharge hole **5*a* allowing the product that is contained inside the tube to be discharged. The lower end is adjacent to the shoulder 11**.

The shoulder 11 extends from the lower end of the neck 5 towards an outer periphery, which in this case is cylindrical, in a direction that is substantially perpendicular to the axis Z-Z', i.e. corresponding to the part of the tube head 3 flaring out from the neck 5. The shoulder 11 is configured so that a tube skirt can be fixed, particularly on its periphery, in order to form the tube.

More specifically, the insert includes a peripheral section, typically of truncated or disc shape, and a central section forming the closure liner, the diameter of which typically corresponds to the inner diameter of the neck 5, at its lower end.

As is particularly shown in FIGS. 1 to 4, the punch 9 axially projects from the rest of the cap 7. The punch 9 is configured so as to be inserted inside the neck 5 of the tube head 3 when the cap 7 is fixed onto the neck 5. The punch 9 is in particular integral with the cap 7.

The punch 9 allows the closure liner to be cut and/or perforated. To this end, it is provided with at least one tooth 25, particularly at least two teeth 25, in this case three teeth. The one or more teeth 25 are advantageously located at a distal end of the punch.

According to the invention, partial cutting is involved. Thus, the closure liner remains connected to the rest of the insert, preventing any of the material forming the insert from being mixed with a product contained in the associated tube and the possible distribution of this material to the user.

A longitudinal direction of the cap 7 is defined, which corresponds to the longitudinal axis Z-Z' of the neck 5 when the cap 7 is fixed onto the neck 5. In general, the punch 9 has a cylindrical section of revolution, the outer diameter of which substantially corresponds to the inner diameter of the neck, to within a close clearance.

The cap 7 according to the invention is configured to transition from a position, called flush position, in which the one or more teeth 25 are flush with the closure liner 12', to a position, called perforation position, in which the one or more teeth 25 have perforated the closure liner, with the cut still pending, then from the perforation position to an end-of-travel position allowing partial cutting of the closure line 12', the transition from the perforation position to the end-of-travel position being carried out with a rotational angular range below 360°.

By distinguishing the part of the travel of the cap that is used to perforate the closure liner, which can vary according to the elasticity of the closure liner, from the part used to cut the closure liner, it is possible for partial cutting of the closure liner to be provided with a limited angular range, which permits limitation of the number of turns required for activation.

Figure 10:
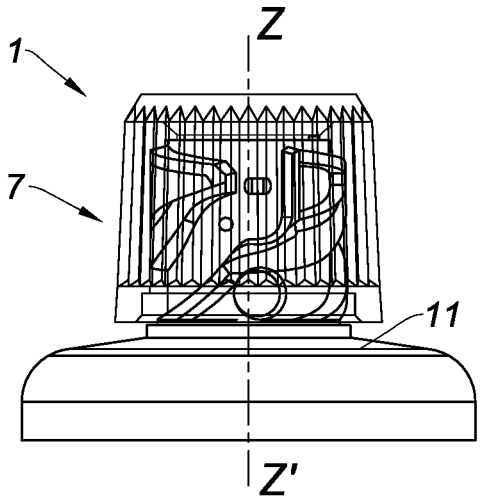
FIG. 10 is as FIG. 7, the closure assembly being in an end-of-travel and/or closed position.

The end-of-travel position can further correspond to a closed position of the cap 7, as is the case in FIG. 10 or 12. In the closed position, the closure liner is cut and the neck 5 and the cap 7 provide a seal for the tube.

According to one aspect of the invention, the height of the one or more teeth 25 is higher than, or equal to, the axial travel of the cap 7 between the perforation position and the end-of-travel position. The height of the teeth is measured, for example, from their large base to their opposite tip.

According to a further aspect of the invention, the cap 25 is configured so that the partial cutting allows the closure liner 12' to remain connected to the tube head via an extension of material on an angular range between 20° and 50°. Such an interval allows the closure liner to be properly set aside, whilst limiting the risks of it ultimately breaking during use.

Figure 8:
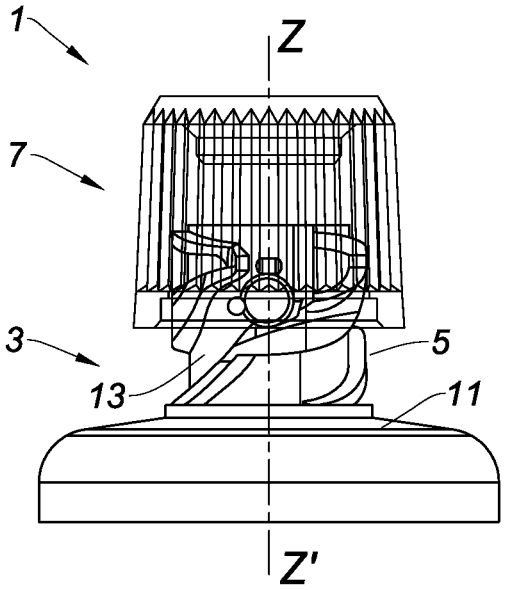
FIG. 8 is as FIG. 7, the closure assembly being in the standby position.
Figure 9:
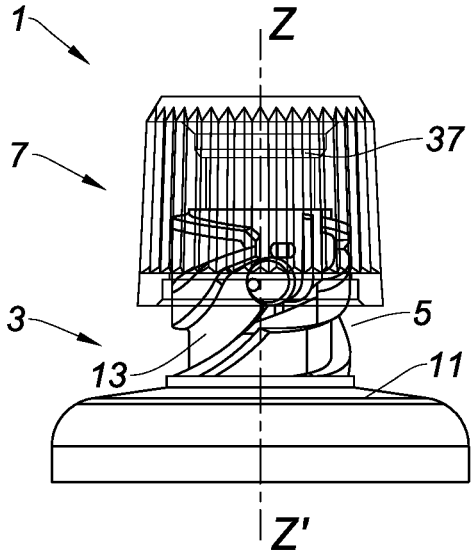
FIG. 9 is as FIG. 7, the closure assembly departing from the standby position and priming a cut of the closure liner.

Advantageously, the assembly is configured to have a standby position, in which the punch 9 is held at a distance from the closure liner, as is the case in FIG. 8 or FIG. 11.

According to a first embodiment, the neck 5 and the cap 7 are configured to themselves allow the cap 7 to be fixedly held on the neck 5 in the standby position (FIG. 8 or 11).

In order for the cap 7 to be able to transition from an open position and/or from the standby position to the end-of-travel and/or closed position, the neck 5 can comprise, for example, at least one guide groove 13 configured to cooperate with the cap 7. In the embodiments shown in FIGS. 5 and 6, the neck 5 includes three grooves 13 allowing the cap 7 to transition from the open and/or standby position to the end-of-travel and/or closed position.

More specifically, the guide grooves 13 of the neck 5 are configured to cooperate with at least one projecting element 15 of the cap 7, particularly to allow the cap 7 to transition from the open and/or standby position to the end-of-travel and/or closed position.

Thus, the groove 13 extends on the outer surface of the neck 5, from the upper end of the neck 5 located in the vicinity of the discharge hole **5*a* to the lower end opposite the upper end. The groove 13 also extends between two edges 17 that radially extend from a base 19 of the groove 13. Preferably, the groove 13 is integral with the neck 5**.

The cap 7 is configured to transition from the open and/or standby position to the end-of-travel and/or closed position by at least one rotational movement, particularly by screwing.

In particular, in the embodiments described herein, the rotational movement is also simultaneously accompanied by an axial movement along the axis Z-Z' and this involves a helical movement.

Advantageously, the transition of the cap 7 from the open and/or standby position to the end-of-travel and/or closed position is reversible. It is thus possible to open and then close the tube after use, and vice versa.

Advantageously, the groove 13 has an inlet 131 located towards the discharge hole **5*a* of the neck 5 and successive guide portions. This can particularly involve a first portion 132** providing the standby position and other portions allowing the transition from the standby position to the end-of-travel and/or closed position.

In particular, the groove 13 has:

- a first portion 132 providing the standby position;
- a second portion 133 allowing the cap 7 to depart from the standby position;
- a third portion 134 allowing the cap 7 to transition via the flush position, then via the perforation position;
- a final portion 135 allowing the cap 7 to transition to the closed position.

In the two variants of a tube head 3 that are shown herein, the first portion 132 is vertical relative to the axis Z-Z'. It is followed by the second portion 133, which is helical with a pitch x, then by the third portion 134, which is helical with a pitch y. The pitch y of the third helical portion 134 is greater than the pitch x of the second helical portion 133. The groove 13 finally terminates at the final portion 135, which is horizontal relative to the axis Z-Z'.

In these two variants, the neck 5 further includes a guide ramp 21 configured to cooperate with at least one of the projecting elements 15 of the cap 7 in order to position the cap at the inlet 131 of the groove 13. The guide ramp 21 allows one of the projecting elements 15 of the cap 7 to be guided in the first portion 132 of the guide groove 13.

Advantageously, the guide ramp 21 has a guide direction opposite the guide direction of the groove 13 for the transition of the cap 7 from the open and/or standby position to the end-of-travel and/or closed position. Thus, in order to position one of the projecting elements 15 of the cap 7 in the inlet 131 of the groove 13, a rotational movement needs to be carried out in a direction opposite that which will be applied in the groove 13. This rotational movement is generally carried out by a machine in an automated manner. Once the cap 7 is in the standby position, a rotational movement needs to be made in a direction opposite that which is applied in the guide ramp 21, generally in the conventional direction of rotation for closing a cap 7, which is generally clockwise, in order for the cap 7 to depart from the standby position and prime the transition towards the end-of-travel and/or closed position. This two-way rotation prevents the machine from excessively rotating when placing the cap 7 in the standby position, from priming a transition to the end-of-travel position and the punch 9 from damaging the closure liner before the tube is used.

Advantageously, the ramp 21 can further comprise a stop 23 for forcing one of the projecting elements 15 of the cap 7 to stop at the inlet 131 of the groove 13. In this case, the stop 23 is an extension of an edge of the first portion 132 of the groove 13 towards the hole 5*a* of the neck 5.

Advantageously, the teeth 25 have a cutting edge and/or end. In this case, this particularly involves an edge 27 of the teeth that is substantially parallel to the longitudinal axis of the cap. Throughout the remainder of the description, when referring to the relative mutual position of the teeth, reference will be made more specifically to the relative position of the cutting edges 27.

Advantageously, the height of at least one first tooth of the teeth 25 is higher than, or equal to, the elongation value of the closure liner. This first tooth 25 is thus configured to perforate the closure liner. In other words, the one or more teeth, in particular the tallest teeth, are tall enough to go beyond and/or compensate for the elongation value of the closure liner. Indeed, an excessively short tooth will tend to insufficiently perforate the closure liner due to the low angular extent of the movement of the cap. With a taller tooth, perforation begins sooner, which is preferable.

Figure 1:
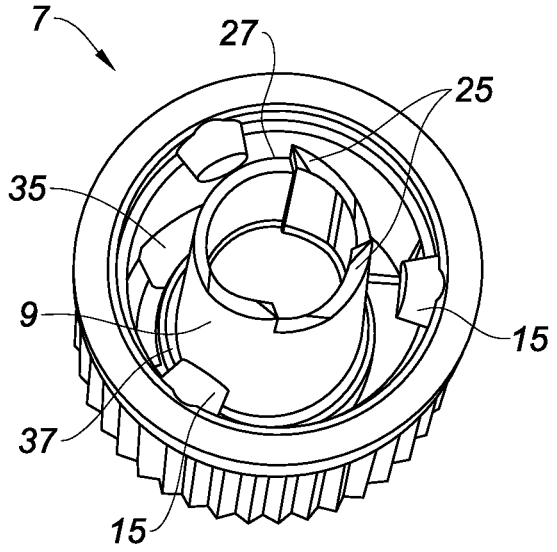
FIGS. 1 and 2 are perspective views of a first embodiment of a cap for a closure assembly according to the invention.
Figure 2:
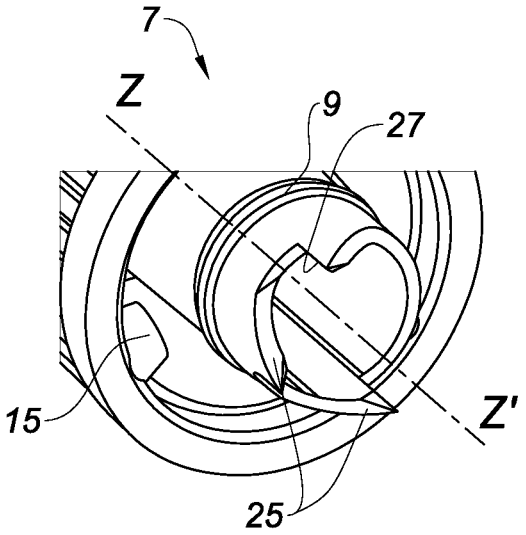

In a first variant as shown in FIGS. 1 and 2, the height of the teeth 25 can be identical. In particular, in this variant, the punch 9 includes three cutting teeth 25, the tips of which are evenly distributed on 180° of the periphery of its distal end.

By way of an example, the height of the teeth is 1 to 3 mm, in particular 1.4 to 2.1 mm. This is particularly the case for a closure liner and/or an insert that is less than 0.3 mm thick.

Figure 3:
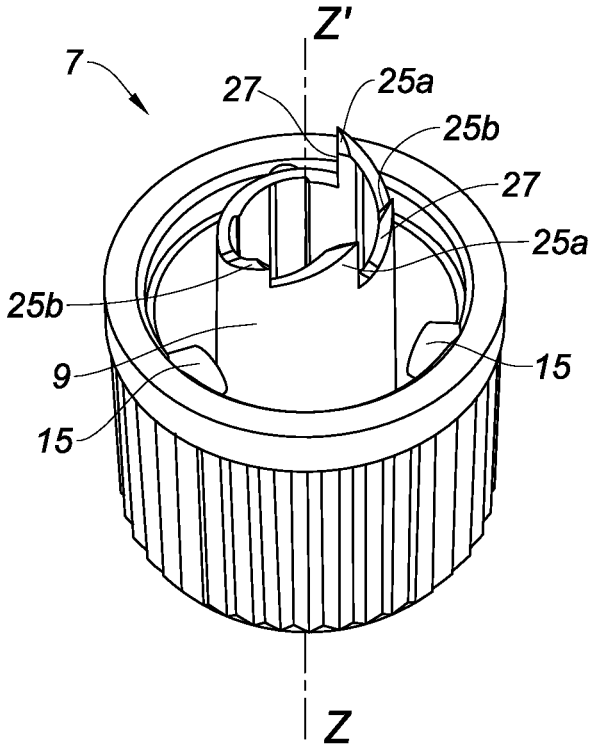
FIGS. 3 and 4 are perspective views of a second embodiment of a cap for a closure assembly according to the invention.
Figure 4:
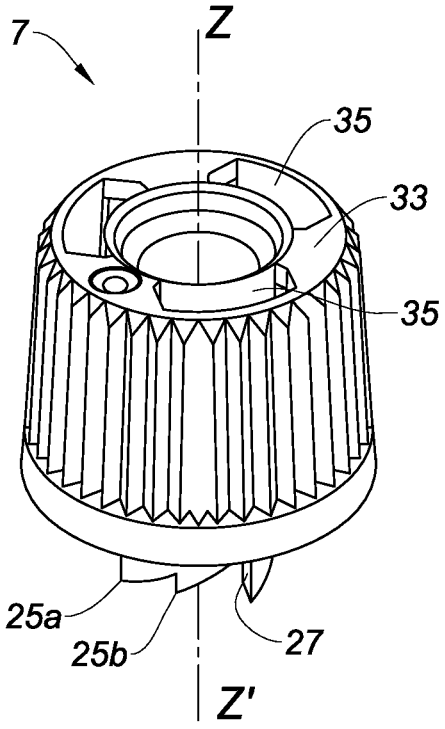
Figure 5:
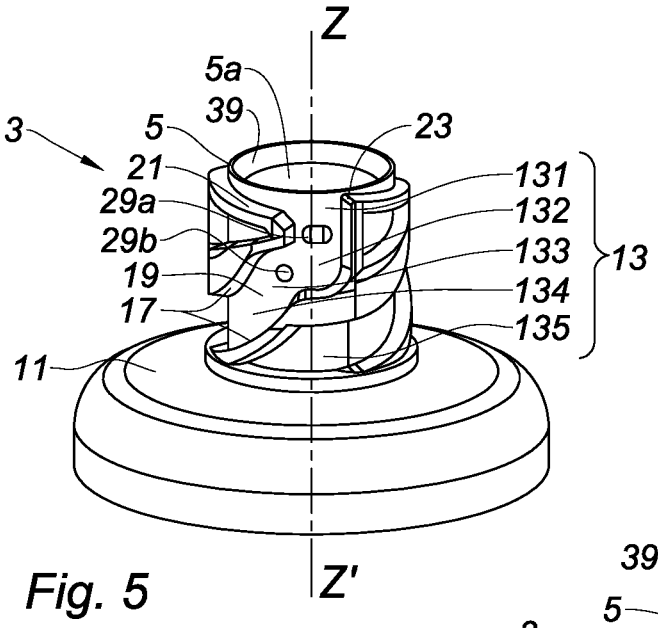
FIG. 5 is a perspective view of a tube, partially shown, including a first variant of a tube head for an assembly according to the invention intended to cooperate with one of the caps of FIGS. 1 to 4.

In a second variant as shown in FIGS. 3 and 4, the heights of the teeth 25 can be different, in particular the height of a second tooth of the teeth 25 can be lower than the elongation value of the closure liner.

Thus, in this variant, the punch 9 has four cutting teeth 25, the tips of which are evenly distributed on 180° of the periphery of its distal end. The height of two of the teeth, called tall teeth 25*a*, is higher than the elongation value of the closure liner and the height of another two of the teeth, called short teeth 25*b*, is lower than the elongation value of the closure liner. The tall teeth 25*a* and the short teeth 25*b* are alternated.

With such a punch profile 9, the closure liner is perforated by the two tall teeth 25*a*, then it is rapidly sheared by these two tall teeth 25*a* using the short teeth 25*b* in order to ultimately obtain a clean and partial cut of the closure liner using a limited number of turns of the cap 7, in this case less than half a turn in particular.

Such a profile, particularly the presence and the alternation of the short 25*b* and tall 25*a* teeth, has the further advantage of reducing and distributing the points of impact of the punch 9 on the closure liner during perforation and limits the risk of tearing the closure liner.

In these two variants, the teeth 25 have a triangular profile, with an orthogonal projection on a plane parallel to the axis Z-Z'. They also have a bevelled profile at the edge 27 shearing the closure liner and/or at their tip. Such a triangular profile allows the tooth to be strengthened at the rear of its bevelled part. This therefore prevents the tooth from deforming during cutting. This also allows the thickness of the tooth to be reduced and better shearing to be obtained as a result. The triangular profile of the tooth thus allows a tooth to be obtained with a larger and more resistant base, particularly when perforating the closure liner, whilst maintaining a sharp side (bevelled edge 27) for perforating, then cutting the closure liner.

The one or more teeth preferably have a curved profile, particularly along an arc of a circle centred on the axis Z-Z'. In the case of a plurality of teeth, the teeth are advantageously on the same arc of a circle.

Advantageously, the neck 5 and the cap 7 each comprise at least one blocking means cooperating together to hold the cap 7 in the standby position.

In the embodiment shown in FIGS. 5 and 7 to 10, the one or more blocking means of the neck 5 are one or more projecting elements 29*a*, 29*b*, 29*c* located on an outer surface of the neck 5.

The neck 5 thus includes two projecting elements that are two catches 29*a*, 29*b* located towards the inlet of the groove 13. More specifically, a first catch 29*a* is located at the inlet of the first portion of the groove 13. This catch 29*a* limits the upwards axial movement of the cap 7 along the axis Z-Z' and allows the cap 7 to be fixedly held on the neck 5 and unwanted removal of the cap 7 to be avoided. The second catch 29*b* is located between the first 132 and the second 133 portions of the groove 13. It permits limitation of the rotational movement of the cap 7, and particularly the departure of the cap 7 from its standby position and its engagement towards the end-of-travel position. In other words, this second catch 29*b* allows the punch 9 to be held away from the closure liner and the perforation and/or the cutting thereof to be avoided without the intervention of the user before the first use.

In the embodiment shown in FIG. 6, the one or more blocking means of the neck 5 are one or more projecting elements 29*a*, 29*b* and 29*c* located on an outer surface of the neck 5.

The projecting elements of the neck 5 are in particular protuberances 29*a*, 29*b*, 29*c* from the edges 17 of the groove 13 extending towards the inside of the groove 13. Thus, the groove 13 has a first protuberance 29*a* located at the inlet of the first portion 132 of the groove 13. This first protuberance 29*a* limits the upwards axial movement of the cap 7 along the axis Z-Z' and allows the cap 7 to be fixedly held on the neck 5 and unwanted removal thereof to be avoided.

The groove 13 also has a second protuberance 29*b*, of the same type, located between the first 132 and the second 133 portions of the groove 13. This second protuberance 29*b* limits the rotational movement of the cap 7 and particularly the departure of the cap 7 from its standby position and its engagement towards the end-of-travel position. In other words, this second protuberance 29*b* allows the punch 9 to be held away from the closure liner and the perforation and/or the cutting thereof to be avoided without the intervention of the user, prior to the first use.

The groove 13 also has a third protuberance 29*c*, of the same type as the protuberances 29*a*, 29*b*, located on the edge 17 opposite that which includes the two first protuberances 29*a*, 29*b*. As is the case for the protuberance 29*b*, this third protuberance limits the rotational movement of the cap 7 and particularly the departure of the cap 7 from its standby position and its engagement towards the end-of-travel position.

In this embodiment, the edges 17 of the groove 13 further comprise at least one protuberance 31 located in the final portion 135 allowing the cap 7 to be held in the closed position. In this case, each edge 17 includes a protuberance 31. These protuberances 31 not only allow the cap 7 to be held in the closed position, but also can be used to act as a closure indicator for the user. Thus, the resistance that is perceived by the user when the projecting elements 15 of the cap 7 surmount the two protuberances 31 tells them that the cap 7 has reached the end of its travel, that it is fully closed and that the seal is provided.

As previously described, in the two embodiments shown in FIGS. 1 to 4, the cap 7 includes at least one projecting element 15 configured to cooperate with the projecting elements 29*a*, 29*b*, 29*c* of the neck 5 to hold the cap 7 in the standby position and to cooperate with the groove 13 of the neck 5 to allow the cap 7 to transition from the standby position to the end-of-travel and/or closed position.

In these two embodiments, the cap 7 includes three projecting elements 15, which allows the cap 7 to be balanced and stabilised when it is in the standby position.

Advantageously, the one or more projecting elements 15 of the cap 7 are located on the lower part of the cap 7 and are integral therewith.

Advantageously, an upper surface 33 of the cap 7 has at least one opening 35 in alignment with the projecting elements 15 of the cap 7. These openings 35 are particularly used to mould the cap 7 and, more specifically, to mould the projecting elements 15. Thus, the number of openings 35 is identical to the number of projecting elements 15 of the cap 7.

In the cap 7 shown herein, the projecting elements 15 of the cap 7 are studs, the diameter of which is substantially similar to the width of the guide grooves 13 to allow the studs to be guided thereby. In this case, the cap 7 includes three studs evenly distributed on the lower part of the cap 7 and three openings 35 on its upper surface in alignment with the studs.

In order to seal the tube when the cap 7 is in the closed position, the cap 7 includes, on the inner face of its upper surface, an overthickness of material that corresponds to a sealing ring 37 located radially set back from the openings. The sealing ring 37 is configured to cooperate with a ring seat 39 provided on an inner surface of the neck 5, at the upper end of the neck 5, when the cap 7 is in the closed position, as can be seen in FIG. 10 or 12.

Various steps for placing the cap 7 in its standby position and for transitioning it from the standby position to the end-of-travel and/or closed position will now be described. These steps relate to the embodiment of the groove 13 shown in FIG. 5.

Firstly, the cap 7 is fixed onto the neck 5 in its standby position. To this end, the projecting elements 15 of the cap 7 are guided in the guide ramp 21 by a rotational movement in the anticlockwise direction. This step can be seen in FIG. 7.

The projecting elements 15 of the cap 7 are then placed in the inlet 131 of the corresponding grooves 13 at their first portion 132. They are held in rightwards abutment by the extension of the first portion 132 of the groove 13 and in downwards abutment by the first catch 29*a* of the neck 5.

The cap 7 is then placed in its standby position by a downwards axial movement, in which each projecting element 15 engaged in the groove 13 is caught beyond the first catch 29*a*. The cap 7 is then held in the standby position by means of the first 29*a* and second 29*b* catches, which limit its leftwards (rotation) and upwards (translation) displacement, as previously described. This standby position can be seen in FIG. 8.

Through a first helical movement, each projecting element 15 of the cap 7 engaged in one of the grooves 13 at the second portion 133 is caught beyond the second catch 29*b* and the cap 7 departs from the standby position. This step can be seen in FIG. 9.

Then, through a second helical movement generated by the third portion 134 of the groove 13, the projecting element 15 transitions to the flush position, then to the perforation position.

The helical movement finally ends when each projecting element 15 engaged in the groove 13 reaches a stop position located at the end of the final portion 15 of the groove 13. The cap 7 is then in the end-of-travel and/or closed position that can be seen in FIG. 10. The closure liner 12' is partially cut.

In order to remove the cap 7, the user completes the steps in the opposite direction.

In the embodiment of the guide groove 13 shown in FIG. 6, the various steps for placing the cap 7 in its standby position and for its transition from the standby position to the end-of-travel and/or closed position are substantially similar.

In the embodiments of FIGS. 1 to 10, prior to use, the cap 7 is held in place on the neck 5 at a distance from the closure liner by matching shapes provided on the cap 7 and the neck 5.

As shown in FIGS. 11 and 12 by way of a variant, the assembly according to the invention includes a detachable ring 50 placed around the neck 5 between the shoulder 11 of the tube head 3 and the cap 7, in order to hold the cap 7 in place at a distance from the closure liner 12', prior to a first use. In other words, the cap 7 is in the standby position (FIG. 11) by virtue of the detachable ring 50.

In this embodiment, the neck 5 is provided with a helical thread 52, for example, advantageously having a pitch that is sufficient enough to allow the rapid screwing of the cap 7.

The cap 7 has teeth 25, in this case three teeth, that can be similar to those previously described.

During the first use, the user removes the cap 7. They then have access to the detachable ring 50, which they remove. They then replace the cap 7, which can be screwed by the user up to its end-of-travel position (FIG. 12) now that the ring 10 has been removed. For the following uses, the end-of-travel position can correspond to the closed position of the cap 7.

Figure 13:
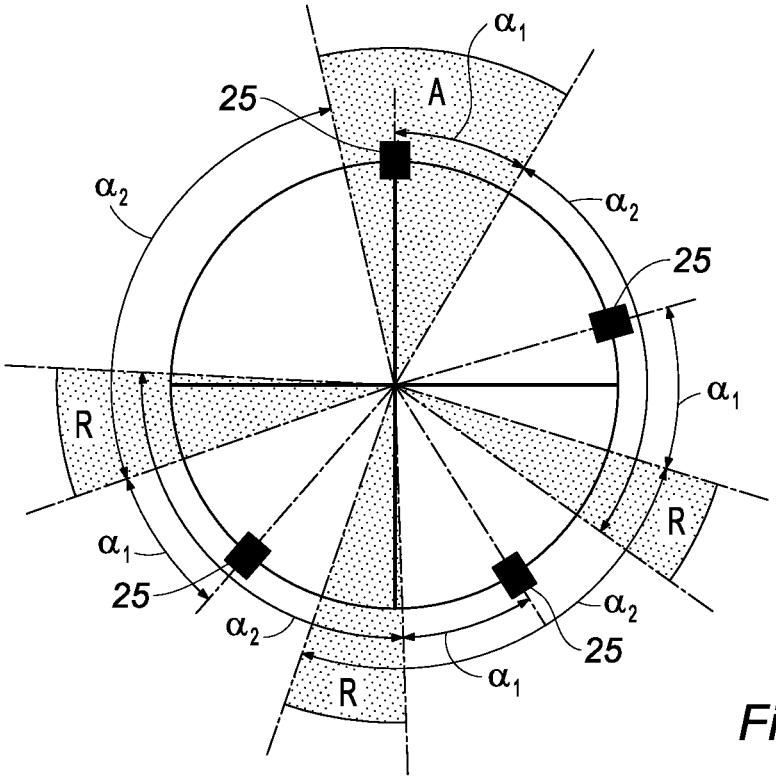
FIG. 13 schematically shows a cut of the closure liner according to a first embodiment of the invention.
Figure 14:
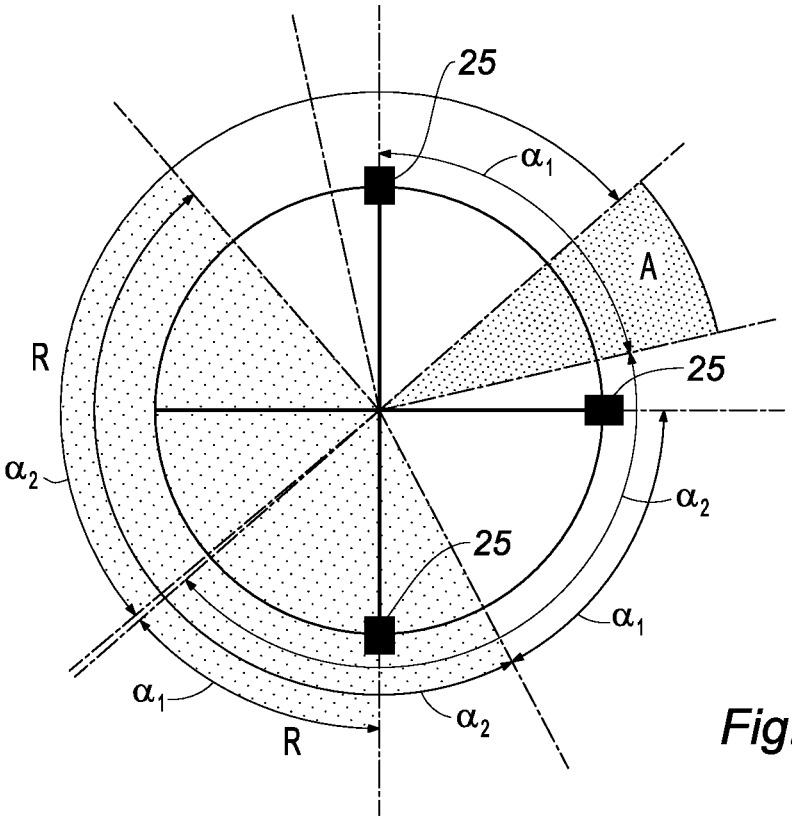
FIG. 14 schematically shows a cut of the closure liner according to a second embodiment of the invention.

As shown in FIGS. 13 and 14, according to two further embodiments, a transition range between the flush position and the end-of-travel position is between 120° and 320°. Furthermore, the teeth 25 are angularly spaced apart from each other so that their angular travel overlaps. In this way, the force perceived by the user for the cut is limited.

Advantageously, the cap 7 is configured so that the transition from the standby position to the end-of-travel position is carried out with an angular rotational range between one and two turns, preferably one and a half turns, and so that the transition from the perforation position to the end-of-travel position is carried out with an angular rotational range between 90° and 200°.

Indeed, the applicant has observed that with such values, the speed of fully opening the cap and the reliable partial cutting of the closure liner are combined during the first use, using closure liners with common resilience.

In these FIG., the location of the teeth 25 is shown by a square that corresponds to the location of their axial cutting edge.

According to a first example, an embodiment of which is shown in FIG. 13, the height of the teeth 25 is identical and the cap is configured so that an overlap of the angular travel between two angularly adjacent teeth is between 20° and 40°.

In this case, there are four of the teeth 25 and they are evenly distributed on 220°, while being separated from each other by approximately 73°.

In the particular embodiment shown, the angular travel of each tooth between the flush position and the end-of-travel position is 126°, with a travel overlap of 23° between two adjacent teeth.

The travel required to transition from the flush position to the perforation position in this case is approximately 30°. It is shown as α1 for each tooth. The travel then used for the cut is thus approximately 96°. It is shown as α2 for each tooth. The overlapping zones are denoted R and the uncut zone of the closure liner 12' is denoted A, which in this case is 44°.

Such an operation is obtained, for example, with a neck 5 and a cap 7 having a screw pitch of 10 mm and an extent of axial displacement of 3.5 mm between the flush position and the end-of-travel position. This being the case, the invention is further applicable to higher pitches.

According to a second example, an embodiment of which is shown in FIG. 14, the height of the teeth 25 decreases in the inverse of the direction of rotation of the cap and the cap is configured so that an overlap of the angular travel between two angularly adjacent teeth is between 20° and 350°.

The angular travel to transition from the position where the relevant tooth is flush with the closure liner, to the position where it has perforated the closure liner, with the cut still pending, increases, starting from the first tooth. The angular cutting overlap between two angularly adjacent teeth decreases starting from the overlap between the first tooth and the second tooth.

In this case, there are three of the teeth 25 and they are evenly distributed on 180°, while being separated from each other by approximately 90°.

In the particular embodiment shown, the angular travel of each tooth between the initial flush position, i.e. the flush position of the first tooth or the taller tooth, and the end-of-travel position, is 229°, with a decreasing cutting overlap between two adjacent teeth, in this case of 89° between the first and the second tooth and 76° between the second and the third tooth.

The travel required to transition from the flush position to the perforation position in this case is approximately 50° for the first tooth, approximately 63° for the second tooth and approximately 76° for the third tooth. It is shown as α1 for each tooth. The travel that is then used for the cut is approximately 179° for the first tooth, 186° for the second tooth and 173° for the third tooth, taking into account the overlapping zones. It is shown as α2 for each tooth. The overlapping zones are denoted R and the zone of the uncut closure liner 12' is denoted A, which in this case is 27°.

Such an operation is obtained, for example, with a neck 5 and a cap 7 having a screw pitch of 5.5 mm and an extent of axial displacement of 3.5 mm between the flush position and the end-of-travel position. This being the case, the invention is further applicable to lower pitches.

In these two examples, the teeth advantageously have a triangular profile similar to that described above.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

I claim:

1. An assembly for closing a tube, said assembly comprising:

a tube head comprising a neck and a closure liner sealing said neck; and, a cap comprising a punch provided with three teeth, said teeth being configured to cut said closure liner, said teeth being evenly distributed on 180°, while being separated from each other by approximately 90°, wherein said punch has a distal end comprising said teeth, said cap being configured to transition from a flush position in which said at least one tooth are flush with said closure liner, to a perforation position, in which said at least one tooth have perforated said closure liner, then from said perforation position to an end-of-travel position allowing partial cutting of said closure liner the transition from said perforation position to said end-of-travel position being carried out with an angular rotational range below 360°, the height of the teeth decreases in the inverse of the direction of rotation of the cap, said cap being configured so that the angular travel of said teeth overlaps between the perforation position and the end-of-travel position.

2. The assembly according to claim 1, wherein the height of said teeth is identical.

3. The assembly according to claim 2, wherein said cap is configured so that an overlap of the angular travel between two angularly adjacent teeth is between 20° and 40°.

4. The assembly according to claim 1, wherein the height of at least one first tooth of said teeth is higher than, or equal to, the elongation value of said closure liner, said tooth being configured to perforate said closure liner.

5. The assembly according to claim 4, wherein the height of a second tooth of said teeth is lower than the elongation value of said closure liner, said second tooth being configured to shear said closure liner.

6. The assembly according to claim 1, wherein the height of said teeth decreases in the inverse of the direction of rotation of the cap.

7. The assembly according to claim 6, wherein said cap is configured so that an overlap of the angular travel between two angularly adjacent teeth is between 20° and 350°.

8. The assembly according to claim 1, wherein the height of the one or more teeth is higher than, or equal to, the axial travel of the cap between said perforation position and said end-of-travel position.

9. The assembly according to claim 1, wherein said cap is configured so that said partial cutting allows said closure liner to remain connected to said tube head via an extension of material on an angular range between 20° and 50°.

10. The assembly according to claim 1, wherein said cap is configured so that the transition from a standby position, in which the punch is held at a distance from the closure liner, to said end-of-travel position, is carried out with an angular rotational range between one and two turns, preferably one and a half turns, and so that the transition from said perforation position to said end-of-travel position is carried out with an angular rotational range between 90° and 200°.

11. The assembly according to claim 1, wherein said neck and said cap are configured to hold said cap in place at a distance from the closure liner, prior to a first use.

12. The assembly according to claim 1, further comprising a detachable ring placed around the neck between a shoulder of the tube head and the cap to hold said cap in place, at a distance from the closure liner, prior to a first use.

13. A closable tube comprising a closure assembly comprising:

a tube; and, a closure assembly comprising:

a tube head comprising a neck and a closure liner sealing said neck; and, a cap comprising a punch provided with three teeth, said teeth being configured to cut said closure liner, said teeth being evenly distributed on 180°, while being separated from each other by approximately 90°, wherein said punch has a distal end comprising said teeth, said cap being configured to transition from a flush position in which said at least one tooth are flush with said closure liner, to a perforation position, in which said at least one tooth have perforated said closure liner, then from said perforation position to an end-of-travel position allowing partial cutting of said closure liner the transition from said perforation position to said end-of-travel position being carried out with an angular rotational range below 360°, the height of the teeth decreases in the inverse of the direction of rotation of the cap, said cap being configured so that the angular travel of said teeth overlaps between the perforation position and the end-of-travel position.

14. The tube of claim 13, wherein said cap is configured so that an overlap of the angular travel between two angularly adjacent teeth is between 20° and 40° and so that said partial cutting allows said closure liner to remain connected to said tube head via an extension of material on an angular range between 20° and 50° and so that the transition from a standby position, in which the punch is held at a distance from the closure liner, to said end-of-travel position, is carried out with an angular rotational range between one and two turns, preferably one and a half turns, and so that the transition from said perforation position to said end-of-travel position is carried out with an angular rotational range between 90° and 200°.

* * * * *